United States Patent [19]

Gasser et al.

[11] Patent Number: 4,884,320

[45] Date of Patent: Dec. 5, 1989

[54] APPARATUS FOR GATHERING A TEXTILE FIBRE FLEECE AND FORMING A FIBRE SLIVER

[75] Inventors: Hermann Gasser, Frauenfeld; Karl Curiger, Pfäffikon; Hans Rutz, Winterthur, all of Switzerland

[73] Assignee: Hollingsworth GmbH, Neubulach, Fed. Rep. of Germany

[21] Appl. No.: 214,082

[22] Filed: Jul. 1, 1988

[30] Foreign Application Priority Data

Jul. 9, 1987 [DE] Fed. Rep. of Germany ..... 3722771

[51] Int. Cl.[4] ..... D01G 15/64

[52] U.S. Cl. ..... 19/106 R

[58] Field of Search ..... 19/106 R, 150, 257

[56] References Cited

FOREIGN PATENT DOCUMENTS 848970 9/1960 United Kingdom ..... 19/150

1177461 1/1970 United Kingdom ..... 19/150

*Primary Examiner*—Werner H. Schroeder

*Assistant Examiner*—Douglas Price

*Attorney, Agent, or Firm*—Townsend and Townsend

[57] ABSTRACT

An apparatus for gathering a textile fibre fleece from a doffer (3) of a card and forming therefrom a fibre sliver which is then fed to a conveyor (7) is disclosed. The apparatus includes a trough (8) which extends from a take-off location defined by a take-off roller (2). The trough (8) has width substantially corresponding to that of the take-off location and has a bottom (9) and side-walls (10) which preferably converge in the shape of a funnel. The apparatus also includes a funnel disposed at one end (19) of the trough (8). The funnel is formed as a compressed-air-operable injector (11) for conveying and forming the sliver (5). End (19) of the trough (8) is connected to exhaustor means (23) which suck the fibre fleece (4) towards injector (11).

20 Claims, 3 Drawing Sheets

APPARATUS FOR GATHERING A TEXTILE FIBRE FLEECE AND FORMING A FIBRE SLIVER

BACKGROUND OF THE INVENTION

The invention relates to apparatus for gathering a textile fibre fleece adapted to be taken off a doffer of a card to thereby form a fibre sliver, and for feeding the fibre sliver to a conveyor for storage or further processing. An apparatus of this type is not known from prior art.

Known devices are only of the type requiring the fibre fleece to be manually gathered at the take-off location, for instance a take-off roller. The thus formed card web has then to be carefully twisted to a fine point permitting it to be introduced into the small round opening of a funnel disposed upstream of a calender roller pair. This procedure is usually rather time-consuming and troublesome. It has to be frequently repeated during operation of the machines, requiring the machines to be capable of low-speed operation. The known apparatus also suffers from the additional disadvantage that the doffed fibre fleece or the card web, respectively, is guided in the open, so that dust particles and short fibres escape to the environment, rendering it practically impossible to comply with environment protection regulations. The known apparatus is moreover susceptible to frequent fleece rupture, resulting in extended downtime of the installation.

It is therefore an object of the present invention to improve the known apparatus in such a manner that it is capable of automatically gather the fibre fleece doffed from the card to form a fibre sliver, and of automatically feeding this fibre sliver to a conveyor, so that fleece ruptures are substantially avoidable.

SUMMARY OF THE INVENTION

For attaining this object, the apparatus according to the invention comprises a trough extending downstream from the take-off location formed specifically by a take-off roller, the trough being of a width substantially corresponding to the take-off location and having a bottom and sidewalls preferably converging in the shape of a funnel, and a compressed air-operable injector located adjacent the end of the trough for shaping the fibre sliver and feeding it to the conveyor, the end of the trough being connected to exhaustor means operable to suck the fibre fleece towards the injector.

The apparatus according to the invention thus in a simple manner permits the fibre fleece to be automatically doffed from a card and to be subsequently gather to the shape of a fibre sliver which is then automatically fed to a conveyor. As the fibre fleece is being taken off the take-off roller of the doffer of a card, it is received on the trough bottom in its fully spread state. The preferably convergent, funnel-shaped sidewalls deflect the lateral portions of the fibre fleece towards the longitudinal center of the trough, so that the fibre fleece is preconstricted. The exhaustor means located adjacent the end of the trough is effective to automatically suck the fibre fleece towards the injector to enter it in the shape of a voluminous fibre sliver. In the injector the fibre sliver is further constricted and subsequently fed to the conveyor or other downstream installations.

The advantage of the apparatus according to the invention does not only lie in the fact that it is no longer required to manually gather and thread the fibre fleece as the operation of the card and associated apparatus is started, but also in the provision that the fibre fleece is continually gathered to the shape of a fibre sliver without the occurrence of irregularities during operation of the apparatus which might otherwise result in fleece rupture.

According to a preferred embodiment of the invention, a fleece blow-off device is disposed adjacent the take-off roller to extend substantially over the full width thereof, the blowing direction of said blow-off device being substantially tangential to the periphery of the take-off roller and directed to the bottom of the trough.

This fleece blow-off device has a triple function. In the first place it is effective to advantageously promote the separation of the fibre fleece from the doffer of a card.

In the second place, the fleece is pre-cleaned by the air jet directed thereon. And in the third place, the air leaving the blow-off device flows into the funnel-shaped trough together with the fibre fleece to thereby enhance the conveying effect of the exhaustor means adjacent the convergent end of the trough.

The end of the trough bottom adjacent the take-off roller is preferably disposed below the take-off roller, and the fleece blow-off device is preferably disposed diametrally opposite the doffer. This arrangement is effective to enhance both the cleaning effect and the conveying effect of the fleece blow-off device. Any foreign bodies blown off the fibre fleece thus impinge on the trough bottom and are carried off therealong.

In a preferred embodiment, the bottom of the trough is of a convex arcuate shape over its full width. This arcuate shape with respect to the conveying path of the fleece aids in uniformly gathering the fibre fleece to the shape of a fibre sliver. In addition, the arcuate shape facilitates the introduction of the fibre sliver into the injector disposed a short distance above the trough bottom. The arcuate shape of the trough bottom results in an effect similar to an airfoil effect, whereby the aspirated air is accelerated with the consequent beneficial effect on the gathering of the fibre fleece to the shape of a fibre sliver.

According to a preferred embodiment, the arcuate shape of the trough bottom, as seen in the feeding direction of the fibre fleece, comprises a rising ramp portion, followed by a substantially horizontal threshold portion and a declining ramp portion extending to the end of the trough. This configuration of the arcuate trough bottom is effective to maintain the airfoil effect, the threshold portion being effective to ensure the accurate guidance of the converging fibre fleece towards the entry opening of the injector.

The inclination angle of the declining ramp portion is preferably greater with respect to the horizontal than that of the rising ramp portion. As a result, the exhaustor means at the end of the trough is disposed a sufficiently great distance away from the advancing fibre sliver as it enters the entry opening of the injector, so that the fibre sliver can lift off the declining ramp portion for directly entering the injector.

According to a preferred aspect, the height of the sidewalls increases towards the end of the trough. This is particularly beneficial when processing a loose fibre fleece, as the thickness thereof increases as it is being laterally constricted in the trough.

In a further embodiment the invention provides that the upper edges of the sidewalls are formed with substantially horizontal deflecting faces directed towards the longitudinal center of the trough. These deflecting faces cause the lateral edges of the fibre fleece to be curled inwards, which is of particular advantage when the operation of the apparatus is started, because the flece is gathered to the form of a loose fibre sliver without any substantial friction.

In order to facilitate the automatic entry of the fibre sliver to which the fibre fleece has been formed in the trough into the injector, the latter is disposed in a housing connected to the exhaustor means and located adjacent the end of the trough, an annular gap being formed between the housing and the injector to open into the trough. This annular gap is used to generate a gas flow in the trough, this gas flow being effective to envelope the fibre fleece and the resultant fibre sliver in the longitudinal direction to thereby hold it together. As the entry opening of the injector is located at the center of this gas flow, the fibre silver pre-formed in the trough is automatically presented to the injector without requiring any manual intervention. The air flow surrounding the fibre sliver is additionally effective to separate foreign matter such as short fibres, dust and the like from the fibre sliver, so that such foreign matter can be passed to a filter installation by the exhaustor means. In this manner the fibre fleece is thoroughly cleaned while at the same time ensuring that the amount of contaminants escaping to the environment is reduced as far as possible.

According to a further preferred embodiment of the invention, the injector comprises a conveyor passage converging in the direction towards the conveyor, and a nozzle passage extending downstream of the conveyor passage and converging towards the conveyor, an annular nozzle gap disposed between the conveyor passage and the nozzle passage being directed towards the conveyor for generating a gas flow. As a result of this construction, the injector enhances the further formation and pre-compacting of the fibre fleece to the fibre sliver, the annular nozzle gap being effective to generate a concentric air flow further constricting the fibre sliver so as to avoid the occurence of friction losses between the fibre sliver and the injector wall.

Preferably the annular nozzle gap has a swirl generator means associated therewith. This swirl generator means imparts a rotary component to the air flow leaving the annular nozzle gap, so that the air flow is stabilized and the fibre sliver is twisted.

The swirl generating means may be formed in a particularly simple manner by the provision of swirl generating grooves in the annular nozzle gap.

For achieving a particularly high degree of reliability in gathering the fibre fleece and introducing it into the conveyor specifically when the operation of the apparatus is started, it is advantageous to provide a second injector located downstream of the first injector in the direction towards the conveyor. The construction of this second injector may be similar to that of the first injector, although with a conveying passage and a nozzle passage of correspondingly reduced diameter.

The conveying passage of the second injector is preferably disposed immediately downstream of the nozzle passage of the first injector and concentric therewith, with an annular gap defined therebetween. The annular gap permits the conveying air injected through the annular nozzle gap to escape to thereby ensure a pressure equalization between the two injectors.

In a particularly advantageous embodiment of this type, the annular gap may be connected to the exhaustor means. This results in ensuring a particularly rapid pressure drop between the two injectors, with the additional effect that any remaining dust particles are exhausted from the fibre sliver.

The nozzle passage of the second injector preferably has a calender roller pair associated therewith and disposed downstream thereof in the conveying direction. This calender roller pair acts to additionally compact the fibre sliver already recompacted by the second injector.

If there are no further processing stations for the fibre sliver provided immediately downstream of the calendar roller pair, it is advantageous to provide a suction pipe of the conveyor immediately downstream of the calender roller pair in the conveying direction. This provision permits the previously compacted fibre sliver to be carried off immediately.

Particularly for the start-up of the installation it is advantageous to provide a fleece exhaustor device above the trough. This is because on start-up of the card from which the fibre fleece is to be doffed, there is initially obtained not a continuous fibre fleece, but rather a number of individual fleece sections. These individual fleece sections are unsuitable for forming a continuous fibre sliver. During start-up of the installation, the fleece exhaustor device may thus be used for exhausting these individual fibres and fleece sections until a continuous fleece is doffed onto the trough. At this time the fleece exhaustor device may be stopped completely, or its suction effect may be reduced, in which case the fleece exhaustor device may be used for exhausting dust particles and short fibres from the fibre fleece.

If the fleece exhaustor device is disposed adjacent the end of the trough upstream of the first injector, its dimensions can be rather small, while it is still ensured that any loose fibres and individual fleece sections are reliably exhausted on start-up of the installation.

For enabling the operation of the apparatus to be controlled in a simple manner, the fleece exhaustor device and the exhaustor means for the housing are advantageously connected to a vacuum source through respective control valves.

According to another advantageous aspect, the blow-off device and the annular nozzle gaps of the injectors are connected to a compressed-air source through respective control valves.

In a preferred embodiment, in which the fleece exhaustor device and the housing exhaustor means are connected to a single vacuum source through a switch valve, the switch valve may be adjusted to a position causing loose fibres and fleece sections produced during the start-up phase of the installation to be exhausted by the fleece exhausting device. At the end of the start-up phase the switch valve may be switched to a position in which the fleece exhaustor device is inoperative, whereas the housing exhaustor means is in communication with the vacuum source to permit the contiuous fleece produced at that time to be sucked into the injector.

An embodiment of the invention shall now be described by way of example with reference to the accompanying drawings.

DETAILED DESCRIPTION OF THE PREFERRED EMBODIMENT

Figure 1:
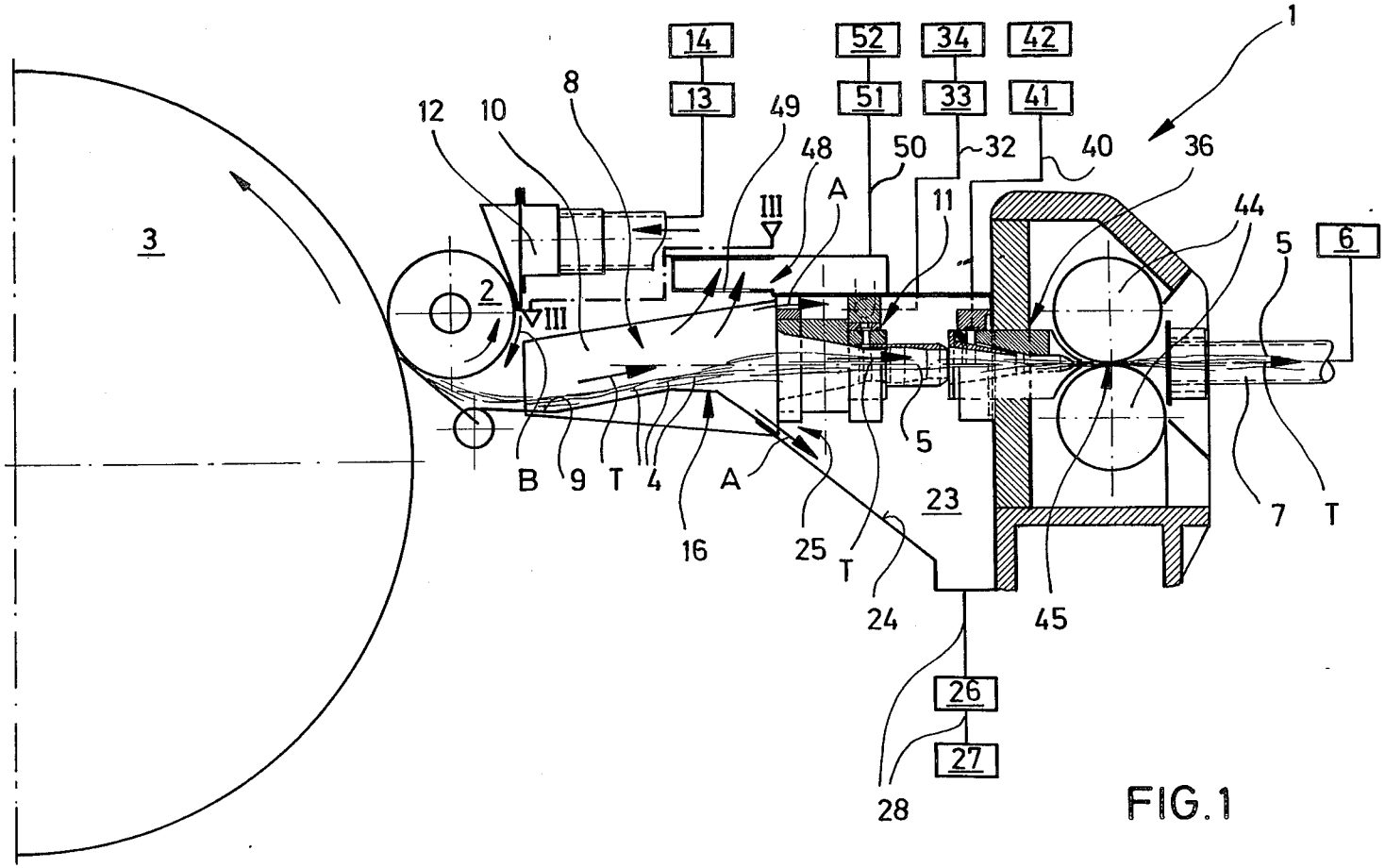
FIG. 1 shows a partially sectioned diagrammatical sideview of an apparatus according to an embodiment of the invention.

Diagrammatically shown in FIG. 1 is a general view of an apparatus 1 for automatically gathering a textile fleece 4 doffed from a doffer 3 of a card by means of a take-off roller 2 to form a fibre sliver 5. In the embodiment of the invention shown in this figure, only part of doffer 3 is illustrated, together with take-off roller 2.

Connected to a downstream end of apparatus 1 is a conveyor pipe 7 connected to a vacuum source 6. Conveyor pipe 7 may lead to a can for storing fibre sliver 5, or to a pre-spinning or spinning station.

Figure 2:
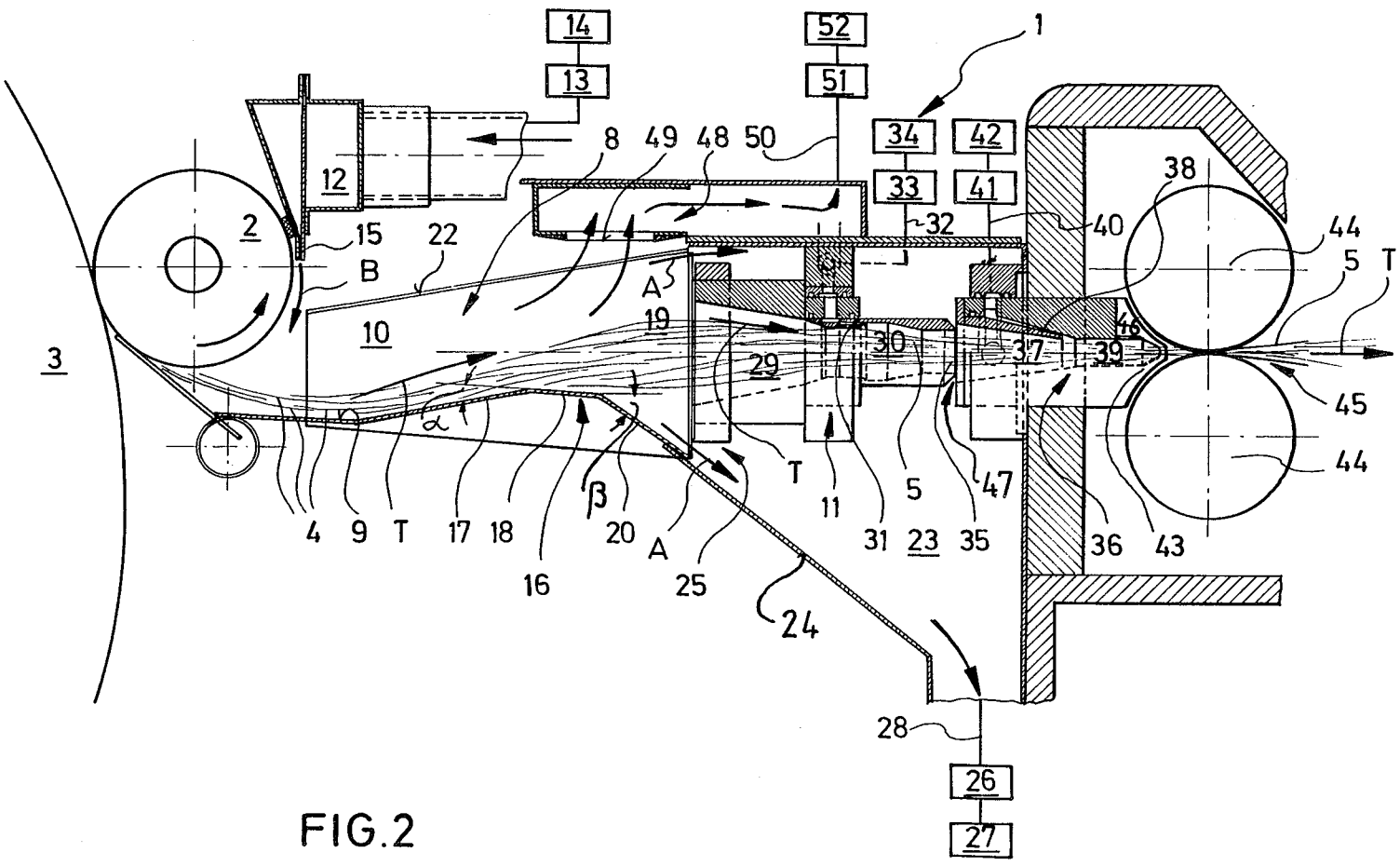
FIG. 2 shows an enlarged sectional view of the center portion of the apparatus shown in FIG. 1.
Figure 3:
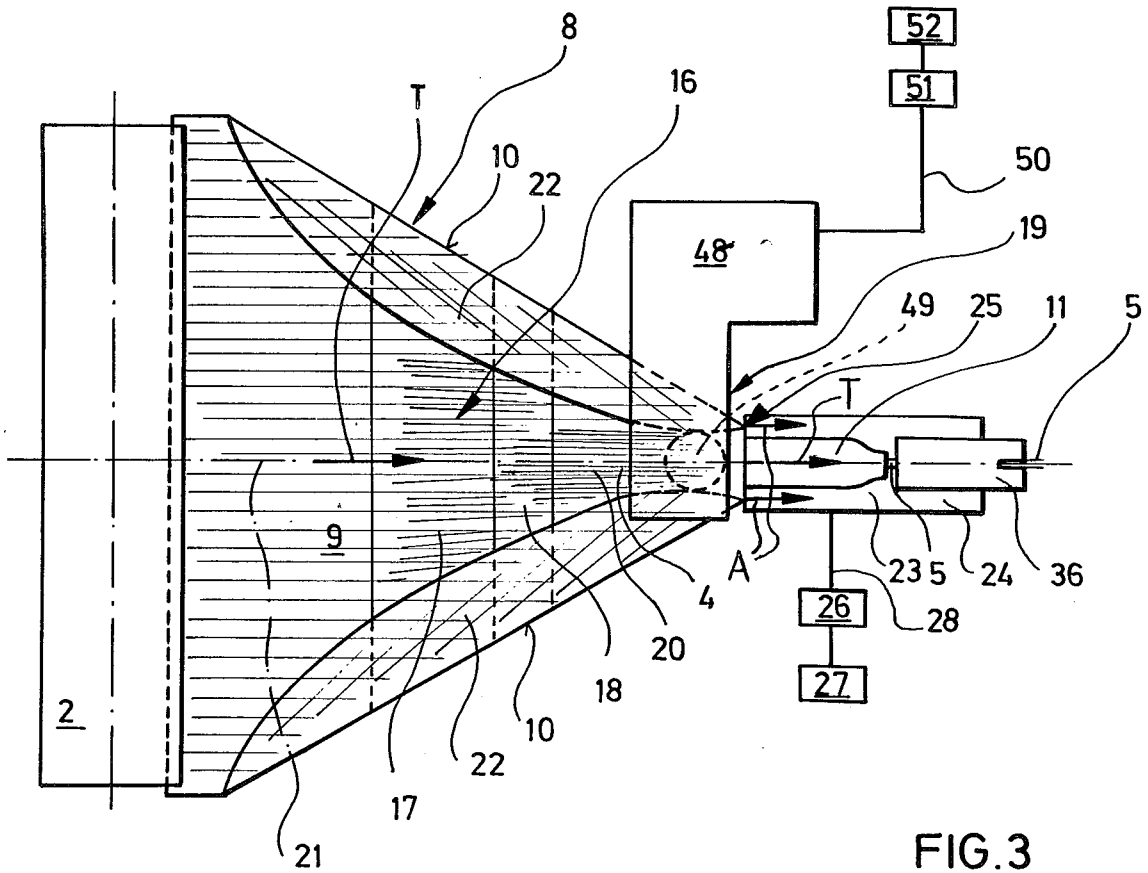
FIG. 3 shows an enlarged diagrammatic view taken along the line III—III in FIG. 1.

As particularly shown in FIGS. 2 and 3, a trough 8 having a bottom 9 and funnel-shaped converging sidewalls 10 is disposed downstream of take-off roller 2.

Disposed downstream of trough 8 in the conveying direction T is a compressed air-operable injector 11 operable to guide fibre sliver 5 into further portions of the apparatus to be described in detail as the description proceeds.

As particularly evident from FIG. 3, the end of trough 8 adjacent take-off roller 2 is of a width substantially corresponding to that of take-off roller 2. From this location trough 8 converges towards the entry opening of injector 11. At this point it is to be specifically noted that FIG. 3 shows a purely diagrammatical illustration not accurately representing the dimensional relationships. For the sake of simplicity the width of the take-off roller is thus shown considerably smaller than the actual width.

As shown particularly clearly in FIG. 2, a fleece blow-off device 12 is disposed adjacent take-off roller 2 to extend substantially over its full width, the blowing direction of blow-off device 12 being substantially tangential to the periphery of take-off roller 2 and downwards onto the bottom 9 of trough 8.

A control valve 13 may be provided for connecting blow-off device 12 to a compressed air source 14 maintained at a slight overpressure of for instance 10 mm head of water. The air flow ejected by blow-off device 12 is generated by a nozzle slot 15 extending substantially over the full width of take-off roller 2.

As likewise clearly shown in FIG. 2, the upstream end of trough bottom 9 is disposed below take-off roller 2, and fleece blow-off device 12 is disposed substantially diametrally opposite doffer 3.

The longitudinal section through trough 8 in FIG. 2 shows that bottom 9 of trough 8 is of an arcuate shape 16 extending uniformly over the full width of bottom 9. The arcuate shape 16 of bottom 9 is similar to the shape of an airfoil aligned in the conveying direction T. As seen in the conveying direction T of fibre fleece 4, the arcuate shape 16 of bottom 9 includes a gently rising first ramp portion 17, followed by a substantially horizontal threshold portion 18 and a declining second ramp portion 20 extending towards the convergent end 19. The inclination angle of declining ramp portion 20 with respect to the horizontal is greater than the inclination angle of rising ramp portion 17.

As further clearly shown in FIG. 2, the height of sidewalls 10 increases from take-off roller 2 towards the narrow end 19 of trough 8.

As shown particularly distinctly in FIG. 3, the upper edges of sidewalls 10 are formed with substantially horizontal deflector faces 22 directed towards the longitudinal center 21 of trough 8.

Trough 8 as a whole, including bottom 9, siderwalls 10 and deflector faces 22 may be integrally formed of sheet metal.

As particularly shown in FIG. 2, the narrow end 19 of trough 8 is connected to exhaustor means 23 acting to convey fibre fleece 4, or the already loosely gathered fibre sliver 5, respectively, towards injector 11.

Injector means 23 comprises a housing 24 disposed adjacent narrow end 19. Injector 11 is disposed within housing 24 in such a manner that an annular gap 25 is formed between the opening of housing 24 facing towards narrow end 19 of trough 8 and the outer periphery of injector 11, this annular gap 25 opening into trough 8.

Housing 24 is connected to a vacuum source 27 via a vacuum pipe 28 and a control valve 26.

The suction flow at the location of annular gap 25 is indicated by arrows A.

Injector 11 itself comprises a conveying passage 29 extending from narrow end 19 of trough 8 and converging in the conveying direction T.

Located downstream of conveying passage 29 in the conveying direction is a nozzle passage 30 likewise converging in the conveying direction T.

Whereas in the embodiment shown, conveying passage 29 is of conically convergent shape, the convergence of nozzle passage 30 proceeds stepwise.

Formed between conveying passage 29 and nozzle passage 30 is an annular nozzle gap 31 for generating a gas flow in the conveying direction T. Annular nozzle gap 31 is located at the inner periphery of injector 11 so as to generate a concentric gas flow. Annular nozzle gap 31 is interiorly formed with swirl generating grooves not shown in the drawings for imparting a swirl movement to the gas flow.

Annular nozzle gap 31 is connected to a compressed-air source 34 via a compressed-air pipe 32 and a control valve 33.

As further shown in FIG. 2, a further injector 36 is located downstream of the opening 35 of nozzle passage 30 in the conveying direction.

The basic construction of this second injector 36 is similar to that of the first injector 11. It is likewise composed of a conically convergent conveying passage 37, an annular nozzle gap 38 and a nozzle passage 39 extending from annular nozzle gap 38, the latter being connected to a compressed-air source 42 via a compressed-air pipe 40 and a control valve 41. Annular nozzle gap 38 is provided with swirl generating grroves not shown in detail in FIG. 2, for imparting a swirl movement to the air flow.

The construction of the outlet opening 43 of second injector 36 is different from that of the outlet opening 35 of the first injector. As shown in FIG. 2, outlet opening 43 of the second injector opens towards a calender roller pair 44 defining a roller gap 45. The fibre sliver 5 leaving outlet opening 43 of second injector 36 is received in roller gap 45. Calender rollers 44 thus act to compact the fibre sliver in the vertical direction.

Outlet opening 43 of second injector 36 is therefore formed as a vertically extended gap 46 in substantially perpendicular alignment with the substantially horizontal roller gap 45 of calender roller pair 44. Vertical gap 46 of outlet opening 43 is outwardly open in the radial direction. At the location of vertical gap 46, the contours of outlet opening 43 are complementary to those of calender roller pair 44.

At the transition from first injector 11 to second injector 36, an annular gap 47 is formed between outlet opening 35 of first injector 11 and the entrance to conveying passage 37 of second injector 36. As also evident from FIG. 2, conveying passage 37 of second injector 36 is likewise disposed within housing 24 in concentric alignment with outlet opening 35. As a result, exhaustor means 23 also acts at the location of annular gap 47. The conveying air supplied to first injector 11 is thus able to escape through annular gap 47 to result in a rapid pressure drop within injectors 11 and 36.

As clearly shown in FIGS. 2 and 3, a fleece exhaustor device 48 is disposed above narrow end 19 of trough 8 immediately upstream of first injector 11. Fleece exhaustor device 48 has an intake opening 49 disposed substantially at the level of the upper edges of sidewalls 10. Intake opening 49 is connected to a vacuum source 52 via a suction pipe 50 and a control valve 51.

The described apparatus according to the invention operates as follows:

During the start-up phase of the card, it produces only discontinuous loose fleece portions. These fleece portions are removed from doffer 3 by take-off roller 2 and then blown off therefrom by fleece blow-off device 12.

Since these discontinuous fleece portions are not yet capable of forming a continuous fibre sliver, fleece exhaustor device 48 is put into operation during this operating phase of apparatus 1. As a result, air is sucked into intake opening 49 to thereby generate a conveying air flow for the discontinuous fleece portions through the funnel-shaped trough 8. The fleece portions travelling through trough 8 are thus caused to lift off bottom 9 at the location of threshold 18 and to enter intake 49 of exhaustor device 48. The thus removed fleece portions may then be separated from the air flow by a separator not shown in detail.

As soon as the start-up phase of the card is terminated, take-off roller 2 proceeds to remove a continuous fibre fleece 4 from doffer 3. Fleece blow-off device 12 operates to blow this continuous fleece 4 onto bottom 9 of trough 8. Since this continuous fibre fleece is capable of forming a continuous fibre sliver, control valve 51 of fleece exhaustor device 48 is closed at least to such a degree that fleece 4 is no longer sucked into intake opening 49.

The control valve 26 of exhaustor means 23, which has already been opened from the beginning, is then opened further, as a result of which annular gap 25 at narrow end 19 of trough 8 generates a stronger conveying air flow for conveying fibre fleece 4 through trough 8 towards first injector 11.

The two control valves 51 and 26 for fleece exhaustor device 48 and exhaustor means 23, respectively, may also be replaced by a common switch valve not shown in the drawings, by way of which both the fleece exhaustor device and the exhaustor means are connected to a vacuum source. On termination of the start-up phase this switch valve may be adjusted to a position in which the fleece exhaustor device is no longer connected to the vacuum source, whereas the housing exhaustor means is connected to the vacuum source. This operation of the switch valve may be controlled by electronic means.

The obliquely converging sidewalls 10 with their deflector faces 22 cause fibre fleece 4 to be gathered to the form of a loose fibre sliver 5.

An important role for obtaining this result is played by the arcuate shape 16 of the bottom 9 of trough 8. The airfoil effect generated by the arcuate shape 16 is effective to reduce the friction between fibre fleece 4 and trough bottom 9. At the declining ramp 20, i.e. downstream of threshold 18, there occurs a vertically directed suction flow prompting the lateral gathering of fibre fleece 4 into a fibre sliver. In this manner the relatively thin fibre fleece 4 entering trough 8 is transformed into a round fibre strand while being conveyed over a very short distance.

The conveying air flow acts to pull this fibre strand into conveying passage 29 of first injector 11. During the start-up phase control valve 33 of first injector 11 is open, so that compressed air is supplied to injector 11 through compressed-air pipe 32 and annular nozzle gap 31. The resulting air flow acts to convey the fibre strand further, as a result of which the fibre strand is further compressed due to the convergent shape of the conveying passage and the nozzle passage. At the same time the swirling motion of the air flow causes the fibre strand to be twisted. The resulting fibre strand may then already be referred to as fibre sliver 5.

First injector 11 acts to transfer the thus formed fibre sliver 5 into second injector 36, the control valve 41 of which is likewise open during the start-up phase, so that second injector 36 is also supplied with compressed air through compressed-air pipe 40 and annular nozzle gap 38. The swirling motion of the resultant air flow causes the leading end of the fibre sliver to be twisted to a fine point which is blown into the roller gap between the calender rollers which operate to transfer the fibre sliver 5 directly into conveyor pipe 7. From that location the fibre sliver 5 may be deposited in a spinning can or subjected to further processing in any suitable manner.

On termination of the start-up phase injectors 11 and 36 are disconnected from the compressed-air source while vacuum source 27 remains operative. From this instant the conveyance of fibre sliver 5 is purely mechanic downstream of first injector 11.

As evident from the above description, the start-up operation of the card including transition to normal operation does not require any manual intervention. The threading of the fibre fleece, i.e. its gathering and the formation of a fine point at its leading end, does not either require any manual intervention. The described apparatus is operable to automatically doff the fibre fleece and feed it to the calender rollers.

The start-up phase is terminated when a sensor (not shown) disposed adjacent the inlet of conveyor pipe 7 detects the leading end of the fibre sliver and generates a signal causing the supply of compressed air to injectors 11 and 36 to be discontinued.

The blowing and exhaustor devices play another important role during normal operation of the installation. The fleece blow-off device 12 thus acts to blow contaminants such as dust, short fibres and small foreign bodies from the advancing fibre fleece. These small-size contaminants enter housing 24 of exhaustor means 23 through annular gap 25 and may then be separated from the air flow by a separator (not shown). Further impurities may be exhausted through annular gap 47 between first injector 11 and second injector 36.

The vertical gap 46 at outlet opening 43 of second injector 36 acts to compress fibre sliver 5 in the lateral direction. The dimensions of fibre sliver 5 leaving outlet opening 43 are thus greater in the vertical direction than in the horizontal direction. The fibre sliver 5 thus supplied to the gap of calender roller pair 44 is then compressed in the vertical direction to subsequently pass through conveyor pipe 7 in the thus formed state.

The top of trough 8 may optionally be closed by a fixed or a removable cover. In addition, fleece exhaustor device 48 and first injector 11 may be laetrally openable for inspection purposes.

The term "trough" is to be understood as designating a component comprising a bottom for carrying the fleece and elements for laterally gathering it. These elements may also be formed as wall portions extending substantially parallel to the doffer axis, in which case the lateral gathering of the fleece is accomplished by the pulling action of injector 11, possibly enhanced by lateral blow nozzles. In this sense the invention is not restricted to the described trough in its concrete configuration. It is also possible to omit the take-off roler 2, in which case the fleece is directly released from the doffer 3 by the blow-off device B or any other suitable means.

We claim:

1. Apparatus for gathering a textile fibre fleece from a doffer (3) of a card and forming therefrom a fibre sliver which is then fed to a conveyor (7) for storage or further processing, said apparatus comprising a trough (8) extending from a take-off location defined by a take-off roller (2), said trough (8) having a width substantially corresponding to that of said take-off location and having a bottom (9) and sidewalls (10) converging in the shape of a funnel, and a funnel disposed at one end (19) of said trough (8), wherein said funnel is formed as a compressed-air-operable injector (11) for conveying and forming the sliver (5), and wherein said end (19) of said trough (8) is connected to exhaustor means (23) for sucking the fibre fleece (4) towards said injector (11).

2. Apparatus according to claim 1, further including a fleece blow-off device (12) disposed adjacent said take-off roller (2) to extend substantially over a full width thereof, a blowing direction (B) of said blow-off device (12) being substantially tangential to a periphery of said take-off roller and directed towards said bottom (9) of said trough (8).

3. Apparatus according to claim 1, wherein an end of said trough bottom (9) adjacent said take-off roller (2) is disposed below said take-off roller (2), and wherein said fleece blow-off device (12) is disposed adjacent said take-off roller (2) substantially at a location diametrically opposite the doffer (3).

4. Apparatus according to claim 1, wherein said bottom (9) of said trough (8) has a convex arcuate shape (16) of uniform configuration extending substantially over its full width.

5. Apparatus according to claim 4, wherein as seen in a feeding direction (T) of the fibre fleece (4), said arcuate shape (16) defines a rising ramp portion (17) followed by a substantially horizontal threshold portion (18) and a declining ramp portion (20) extending towards said end (19) of said trough (8).

6. Apparatus according to claim 5, wherein an angle of inclination of said declining ramp portion (20) is greater with respect to the horizontal than an angle of inclination of said rising ramp portion (17).

7. Apparatus according to claim 1, wherein a height of said sidewalls (10) increases towards said end (19) of said trough (8).

8. Apparatus according to claim 1, wherein said sidewalls (10) includes top edges which are formed with substantially horizontal deflector faces (22) directed towards a longitudinal center of said trough.

9. Apparatus according to claim 1, further including a housing (24) connected to said exhaustor means (23), said housing being disposed adjacent said end (19) of said trough (8), said injector (11) being disposed in said housing (24), an annular gap (25) being formed between said housing (24) and said injector (11) to open into said trough.

10. Apparatus according to claim 1, wherein said injector (11) comprises a conveyor passage (29) converging towards said conveyor (7), and a nozzle passage (30) extending from said conveyor passage (29) in a feeding direction (T) and converging towards said conveyor (7), an annular nozzle gap (31) directed towards said conveyor (7) being disposed between said conveyor passage (29) and said nozzle passage (30) for generating a gas flow.

11. Apparatus according to claim 1, further including a second injector (36) disposed downstream of said injector (11) in a direction towards said conveyor (7).

12. Apparatus according to claim 11, wherein said second injector (36) includes a conveyor passage (37) which is concentrically aligned with a nozzle passage of said first injector (11), with an annular gap (47) being defined therebetween.

13. Apparatus according to claim 12, wherein said annular gap (47) is connected to said exhaustor means (23).

14. Apparatus according to claim 11, wherein said second injector (36) includes a nozzle passage (39) having a calendar roller pair (44) associated therewith disposed downstream thereof in a conveying direction (T).

15. Apparatus according to claim 14, wherein said conveyor (7) includes a suction pipe which extends from said calendar roller pair (44) in the conveying direction (T).

16. Apparatus according to claim 1, further including a fleece exhaustor device (48) disposed above said trough (8).

17. Apparatus according to claim 16, wherein said fleece exhaustor device (48) is disposed adjacent said end (19) of said trough (8) upstream of said first injector (11).

18. Apparatus according to claim 16, further including a vacuum source (52, 27) and control valves (51, 26), said fleece exhaustor device (48) and said exhaustor means (23) for said housing (24) being connected to said vacuum through respective said control valves (51, 26).

19. Apparatus according to claim 16, further including a vacuum source and switch valve, said fleece exhaustor device and said exhaustor means for said housing being connected to said vacuum source through said switch valve operable to selectively establish communication between said vacuum source and a chosen one of said fleece exhaustor device and said exhaustor means.

20. Apparartus according to claim 2, further including a compressed-air source (14, 34, 42), control valves (13, 33, 41) and a second injector (36) disposed downstream of said injector (11) in a direction towards said conveyor (7), said injectors (11, 36) including annular nozzle gaps (31, 38), wherein said blow-off device (12) and said annular nozzle gaps (31, 38) of said injectors (11, 36) are connected to said compressed-air source (14, 34, 42) through respective said control valves (13, 33, 41).

* * * * *